United States Patent [19]

Geschwender

[11] Patent Number: 4,557,200

[45] Date of Patent: Dec. 10, 1985

[54] TRAY WITH FOLDING LEGS

[75] Inventor: Robert C. Geschwender, Lincoln, Nebr.

[73] Assignee: New Products I, Ltd., Lincoln, Nebr.

[21] Appl. No.: 523,167

[22] Filed: Aug. 15, 1983

[51] Int. Cl.[4] ..... A47B 3/00; F16M 11/38

[52] U.S. Cl. ..... 108/132; 108/133; 248/439

[58] Field of Search ..... 108/133, 132, 131, 129, 108/91, 130, 53.1; 292/177, 175; 70/312

[56] References Cited

U.S. PATENT DOCUMENTS

| | | | |
|---|---|---|---|
| 329,494 | 11/1885 | Schweinfurt | 292/175 |
| 375,604 | 12/1887 | Cedarvall | 292/175 |
| 1,309,774 | 7/1919 | Otte . | |
| 1,709,927 | 4/1929 | Whitney | 248/439 X |
| 1,709,928 | 4/1929 | Whitney . | |
| 2,459,529 | 1/1949 | Jogwick et al. | 311/85 |
| 2,490,318 | 12/1949 | Padon | 108/131 |
| 2,889,185 | 6/1959 | Heisler | 108/91 |

FOREIGN PATENT DOCUMENTS

| | | | |
|---|---|---|---|
| 288342 | 10/1968 | Australia | 108/129 |
| 699935 | 11/1953 | United Kingdom | 108/129 |
| 1349166 | 3/1974 | United Kingdom | 108/131 |

*Primary Examiner*—William E. Lyddane
*Assistant Examiner*—José V. Chen
*Attorney, Agent, or Firm*—Senniger, Powers, Leavitt and Roedel

[57] ABSTRACT

A generally rectangular tray having a pair of legs pivoted on the tray at opposite sides thereof for swinging between a folded position and an unfolded position in which the legs extend down from the tray for supporting it. Each leg has spaced apart side portions interconnected for resilient springing movement of the side portions with respect to one another, latches engageable by the legs for releasably latching the legs in folded position and actuators operable by a person holding the tray at opposite sides thereof for springing the side portions of each leg with respect to one another to move the legs out of latching engagement with their respective latches. This disengagement enables the legs to swing down by gravity from their folded position to their unfolded position for supporting the tray.

18 Claims, 11 Drawing Figures

TRAY WITH FOLDING LEGS

BACKGROUND OF THE INVENTION

This invention relates generally to a tray having folding legs for use either as a service tray or as a small table.

The present invention is in the same general field as the devices shown in U.S. Pat. Nos. 1,309,774, 1,709,928 and 2,459,529 and represents an improvement thereover.

SUMMARY OF THE INVENTION

Among the several objects of this invention may be noted the provision of an improved tray having foldable legs at its ends for use of the tray as a small table; the provision of such a tray wherein the legs of the tray may be actuated to swing down to their unfolded tray-supporting position while grasping the tray with both hands; the provision of such a tray wherein the legs of the tray are latchable in their folded and unfolded positions; the provision of such a tray wherein the legs may readily be unlatched from their unfolded position to swing back up to their folded positions; the provision of such a tray which will readily stack either crosswise or in alignment with other trays of similar type; the provision of such a tray which is relatively lightweight yet sturdy; the provision of such a tray which is attractive in appearance; and the provision of such a tray which is of relatively simple construction for economical manufacture.

In general, this invention involves a generally rectangular tray having a pair of legs pivoted on the tray at opposite sides thereof for swinging between a folded position and an unfolded position in which the legs extend down from the tray for supporting it. Each leg has spaced apart side portions interconnected for resilient springing movement of the side portions with respect to one another, latch means engageable by the legs for releasably latching the legs in folded position and actuator means operable by a person holding the tray at the opposite sides thereof for springing the side portions of each leg with respect to one another to move the legs out of latching engagement with said latch means. This disengagement enables the legs to swing down by gravity from their folded position to their unfolded position for supporting the tray.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
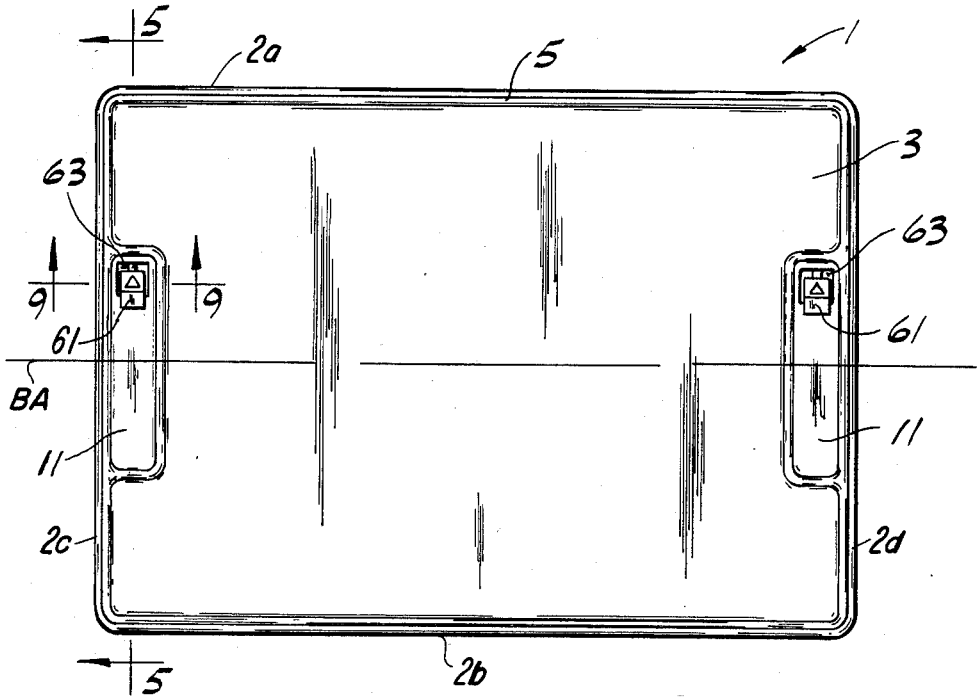
FIG. 1 is a top plan of the tray of the present invention.

Referring now to the drawings, a tray of the present invention is indicated in its entirety by the reference numberal 1. As shown, the tray is generally rectangular in shape, having a first pair of opposing sides 2*a*, 2*b*, a second pair of opposing sides (or ends) 2*c*, 2*d*, and a central balance axis BA extending generally parallel to said first pair of sides 2*a*, 2*b* and generally midway therebetween. The tray has a generally flat upper surface or top 3 with a relatively low rim 5 and a depending peripheral skirt 7. The latter is recessed at opposite sides (ends) of the tray 2*c*, 2*d* generally at balance axis BA as indicated at 9 to form handles for grasping the tray with both hands. The upper surface 3 of the tray has a pair of elongate depressions (each designated 11) therein adjacent the ends of the tray. These also function as handles for the tray. The top of the tray, the rim and the skirt are all preferably of one-piece molded plastic construction to minimize the weight of the tray and to provide an attractive appearance.

Figure 2:
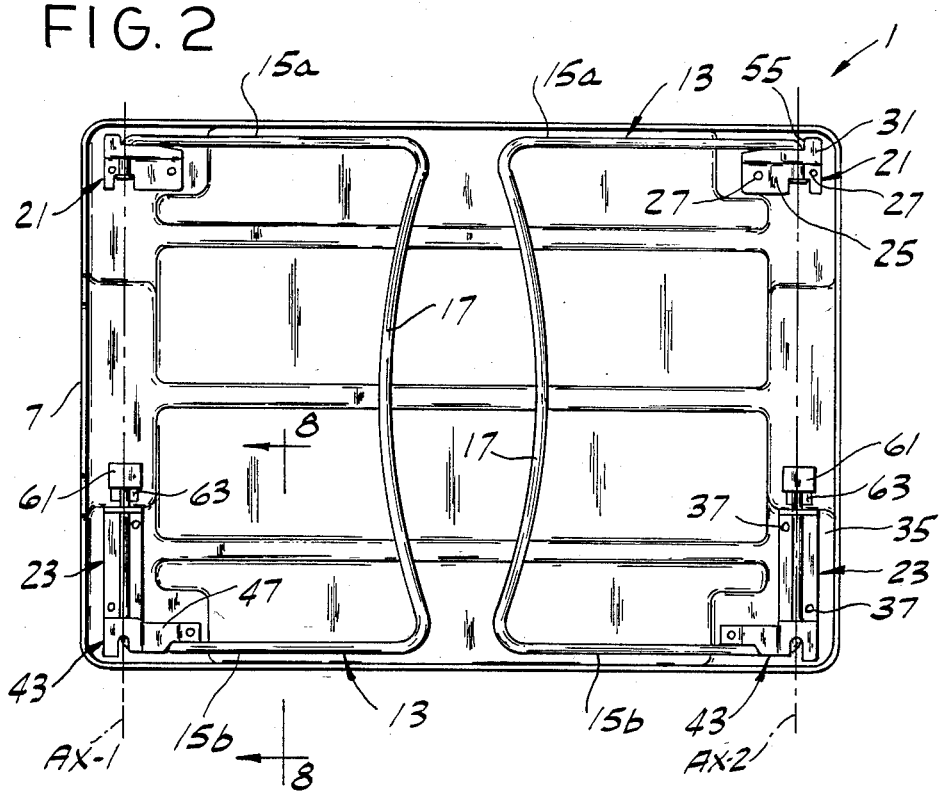
FIG. 2 is a bottom plan of the tray showing legs of the tray in a folded position.
Figure 3:
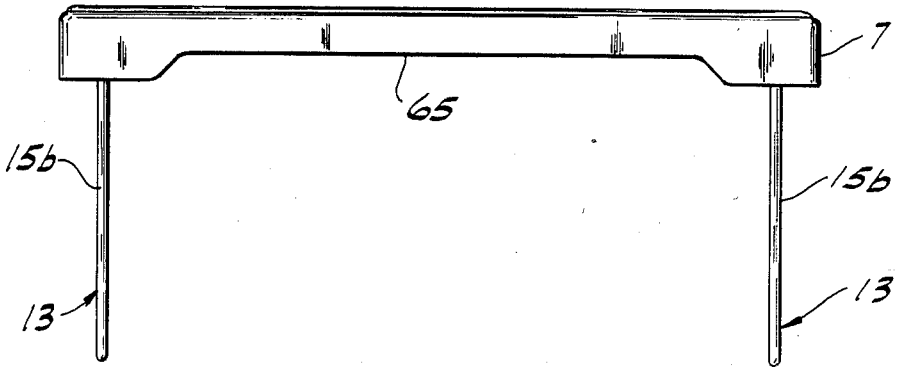
FIG. 3 is a side elevation of the tray showing the legs in unfolded position.
Figure 4:
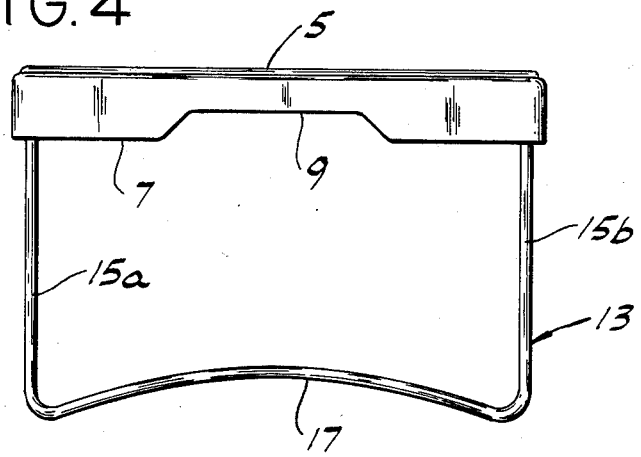
FIG. 4 is a left end elevation of the tray shown in FIG. 3.

A pair of legs, each generally designated 13, are pivoted on the underside of the tray at opposite sides thereof (i.e., the left and right ends of the tray as viewed in FIG. 2) for swinging about parallel axes AX1, AX2 extending generally transversely of the tray between a folded position (FIG. 2) in which the legs lie generally flat against the underside of the tray, and an unfolded position (FIG. 3) in which the legs extend down from the tray for supporting it. The legs are preferably formed from metal rod bent into generally U-shaped, each leg thus having spaced-apart side portions 15*a*, 15*b* and a connecting portion 17, the latter being arcuate in shape. The legs 13 may be made from material other than metal (e.g., plastic) so long as the side portions of each leg are capable of resilient springing movement with respect to one another, which is important for reasons which will become apparent.

Figure 5:
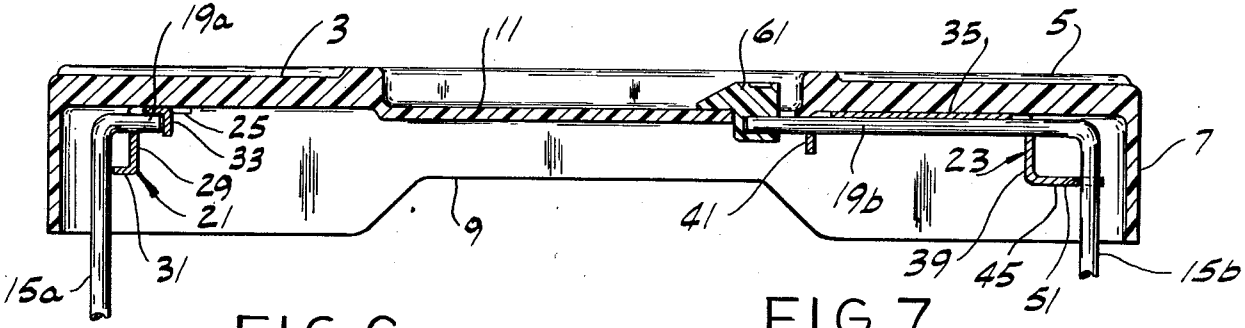
FIG. 5 is an enlarged vertical section taken on line 5—5 of FIG. 1.

As illustrated best in FIG. 5, the two side portions 15*a*, 15*b* of each leg have end portions designated 19*a* and 19*b*, respectively, bent inwardly toward one another generally at right angles to the side portions, end portion 19*a* being relatively short and end portion 19*b* relatively long. These leg end portions 19*a*, 19*b* are journaled in respective pivot members generally designated 21 and 23 on the underside of the tray for enabling the leg to swing between its stated folded and unfolded positions.

Pivot member 21 comprises a horizontal flange 25 suitably fastened (as by screws 27) to the underside of the tray and a depending vertical flange 29 lying in a plane generally perpendicular to the pivot axis of the leg 13. The lower end of this latter flange 29 is bent as indicated at 31 to extend generally horizontally outwardly. The relatively short end portion 19*a* of a respective leg 13 extends through an opening in the vertical flange 29 and is engageable with a tab 33 struck out from the horizontal flange 25 of the pivot member.

Pivot member 23 is generally U-shaped, having a horizontal web portion 35 suitably fastened (as by screws 37) to the underside of the tray, and a pair of depending generally parallel flanges at opposite sides of the web portion, the first or outer flange being designated 39 and the second or inner flange being designated 41. Both flanges 39, 41 lie in planes generally perpendicular to the pivot axis of a respective leg. The relatively long end portion **19*b* of a respective leg extends through aligned openings in these flanges 39, 41**.

Figure 8:
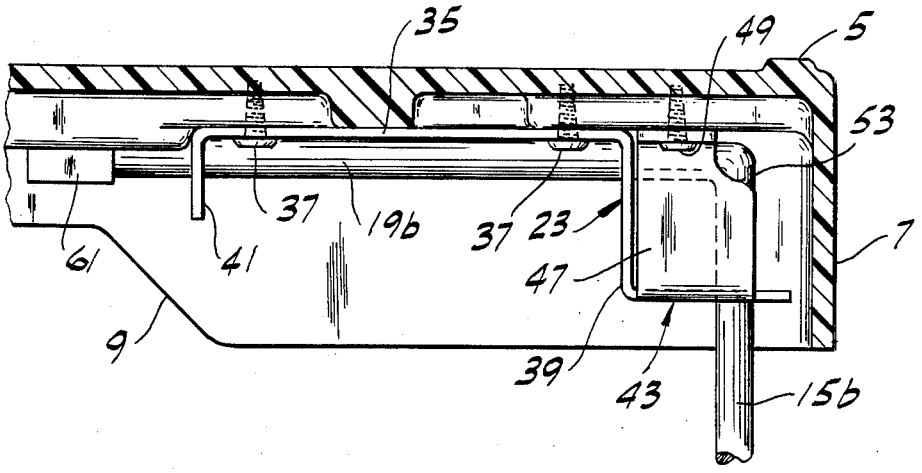
FIG. 8 is an enlarged vertical section on line 8—8 of FIG. 2 showing a leg latched in its unfolded, tray-supporting position.
Figure 6:
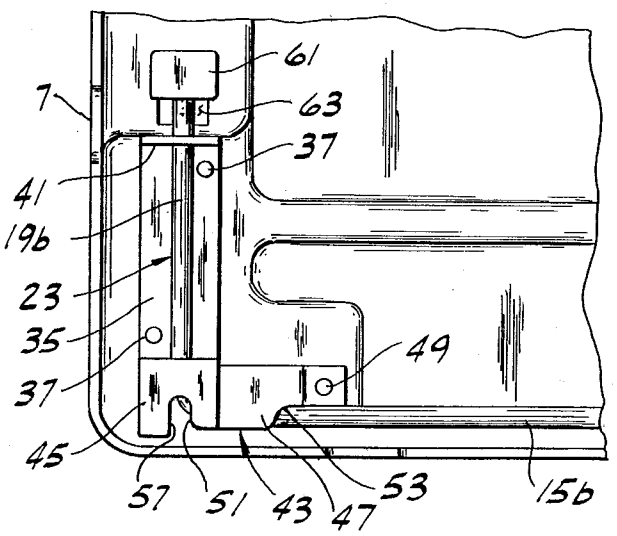
FIG. 6 is an enlarged portion of FIG. 2 showing a latch member on the underside of the tray latching a respective leg in its folded position.
Figure 9:
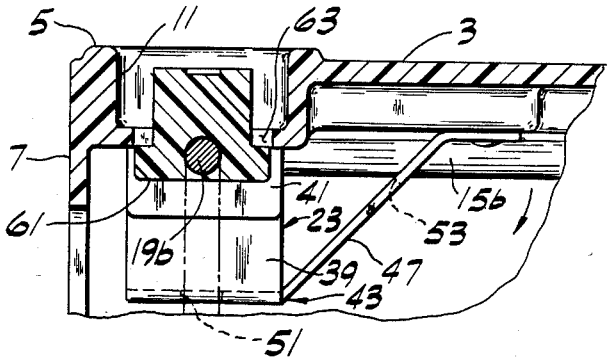
FIG. 9 is an enlarged vertical section taken on line 9—9 of FIG. 1.

Two latch members, each generally designated 43, are provided on the underside of the tray for releasably latching the legs 13 in their stated folded and unfolded positions. These latch members 43 are located at the lower ends of the outer flanges 39 of pivot members 23 and are constituted by integral extensions thereof. As illustrated best in FIGS. 6, 8 and 9, each latch member comprises a first generally horizontal flange portion 45 bent from the lower end of a respective outer flange 39, and a second flange portion 47 inclined upwardly from the horizontal portion 45 away from the outer flange for securement by a suitable fastener 49 to the underside of the tray. The horizontal flange portion 45 of the latch member 43 has a first notch 51 therein extending inwardly from its outer edge for receiving a respective leg side portion **15*b* thereby releasably to latch the leg in its unfolded (tray-supporting) position; and the inclined flange portion 47 has a second notch 53 therein extending inwardly from its outer edge for receiving a respective leg side portion 15*b* thereby releasably to latch the leg in its folded position. Side portions 15*b* of the legs are urged into the notches 51, 53 by the spring action of the legs, it being noted in this regard that the two side portions 15*a*, 15*b* of each leg are so spaced with respect to one another that when side portion 15*b* is in one of the two notches 51, 53, the leg is generally unstressed. When the legs are in their unfolded tray-supporting position, the side portions 15*a*, 15*b* of each leg are engageable with an edge 55 of extension 31 on pivot member 21 (FIG. 2) and with an edge 57 of the horizontal flange portion 45 of latch member 43 (FIG. 6), edges 55 and 57** thus constituting stop means for providing further assurance that the leg will not swing past its vertical tray-supporting position.

In accordance with this invention, actuating means comprising two actuator buttons, each designated 61, are provided for springing the side portions **15*a*, 15*b* of each leg 13 with respect to one another to move the legs out of notches 53 for enabling the legs to swing down by gravity from their folded position to their unfolded position, and out of notches 51 enabling the legs to swing from their unfolded positions back to their folded position. These actuator buttons 61 are connected to (e.g., slip-fitted on) the free ends of the relatively long end portions 19*b* of the legs and are slidable in slots 63 in the tray at the bottom of the depressions 11 in the tray. The tops or heads of the buttons are engageable by the thumbs of a person grasping the tray at its ends for sliding the buttons in the slots 63 to spring the leg side portions 15*a*, 15*b* away from one another and out of whichever notches the leg portions are in to enable the legs to be pivoted. The depressions 11** are sufficiently deep to ensure that the heads of the buttons do not project above the upper surface of the tray.

Figure 7:
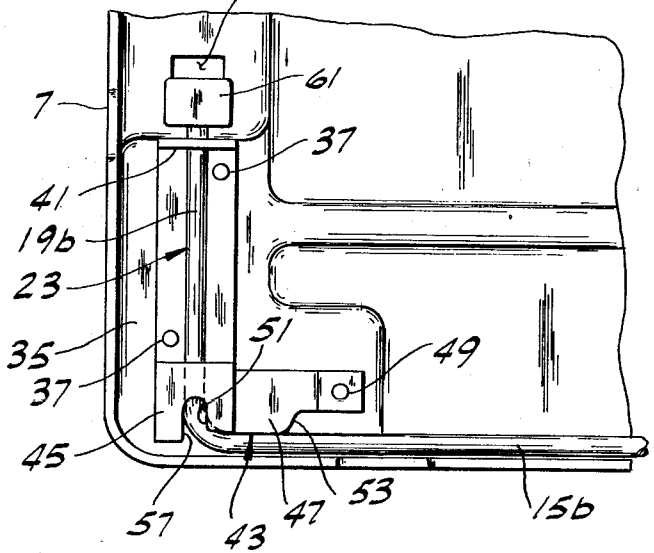
FIG. 7 is a view similar to FIG. 6 showing the leg moved out of latching engagement with the latch member.

Thus the legs of the tray may conveniently be unfolded when the tray is in a serving position with its top facing upwardly while holding the tray with both hands positioned generally midway of sides **2*c*, 2*d* generally on balance axis BA to maintain the tray balanced. This is accomplished simply by sliding to spring the side portions 15*b* of the legs out of notches 53 (see FIG. 7), whereupon the legs will swing down by gravity toward their tray-supporting position. Upon reaching that position, the side portions 15*b* will snap (i.e., spring) into notches 51 to latch the legs in their unfolded positions. To return the legs to their folded positions, the tray may be turned upside down, and the actuator buttons slidably moved to spring the leg side portions 15*b* out of the notches 51, which enables the legs to swing down to their folded position where they snap into notches 53** and are thus latched in positiin.

Figure 10:
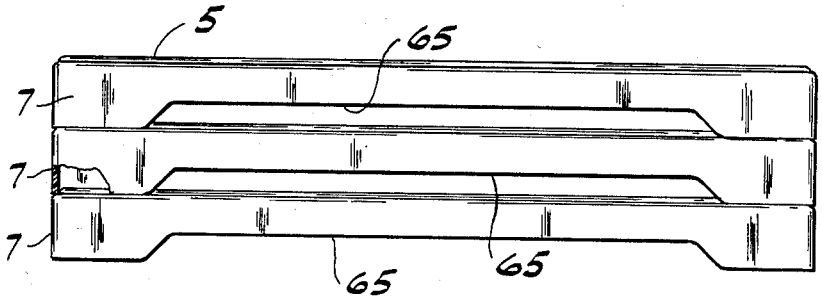
FIGS. 10 and 11 are views showing different ways trays of the present invention may be stacked.
Figure 11:
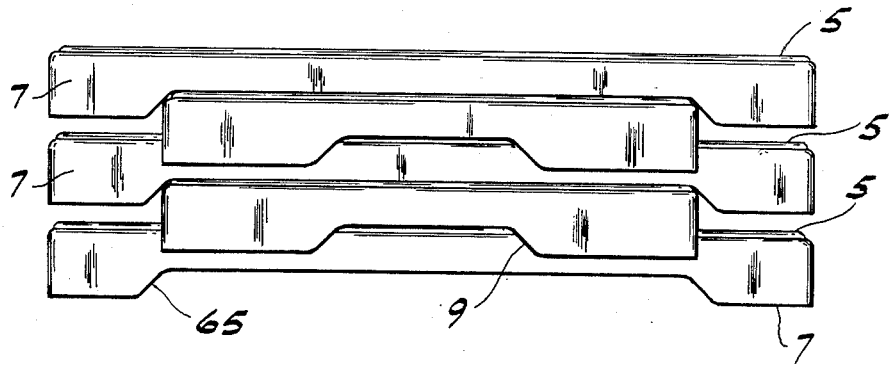

The tray of the present invention is designed to be stacked with other trays of the same design. It will be observed in this regard from FIG. 1 that the rim 5 at the top of the tray is set inwardly from the periphery of the tray a distance corresponding to the thickness of the skirt 7 on the tray. Thus, when one tray is stacked on another, the rim on the lower tray serves to locate and hold the tray thereabove in the proper position (see FIG. 10). Several trays of this invention may also be stacked crosswise relative to one another (see FIG. 11), the sides of each tray being recessed as indicated at 65 to facilitate this, the width of the recess in each side corresponding approximately to the width of the tray.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A generally rectangular tray having a pair of legs pivoted on the underside of the tray at opposite sides thereof for swinging between a folded position in which the legs are folded up adjacent the underside of the tray and an unfolded position in which the legs extend down from the tray for supporting it, each leg having spaced apart side portions interconnected for resilient springing movement of the side portions with respect to one another, latches on the underside of the tray for releasably latching the legs in folded position, and actuator means on the tray engageable with said legs and operable by a person while holding the tray in a serving position for springing the side portions of each leg with respect to one another thereby to disengage the legs from their respective latches for enabling the legs to swing down by gravity from their folded position to their unfolded position for supporting the tray, said actuator means comprising a pair of actuators movably mounted on said opposite sides of the tray and positioned generally midway of respective sides whereby said actuators may be moved by hand while holding the tray in said serving position with both hands positioned generally midway of said opposite sides thereby to spring respective side portions of respective legs with respect to one another.

2. A tray as set forth in claim 1 wherein said latches are also adapted for latching said legs in said unfolded position.

3. A tray as set forth in claim 1 wherein said actuators are adapted for springing the side portions of each leg away from one another to move the legs out of engagement with said latch means.

4. A tray as set forth in claim 3 wherein said actuators are in the form of buttons operatively connected to said legs and slidable in slots in the tray for springing respective side portions of the legs with respect to one another.

5. A tray as set forth in claim 4 wherein said actuator buttons are disposed within recesses in the tray so that the buttons do not project above the top of the tray.

6. A tray as set forth in claim 1 wherein the side portions of each leg have end portions bent generally at right angles with respect to the side portions and journaled in a pair of pivot members on the underside of the tray for enabling the leg to swing between its folded and unfolded positions, each actuator having an operative connection with one end portion of a respective leg side portion whereby movement of the actuator effects springing of respective leg side portions with respect to one another.

7. A tray as set forth in claim 6 wherein said latch means comprises a latch member on one pivot member of each pair of pivot members, said latch member having a first notch therein for receiving a respective side portion of a respective leg releasably to latch the leg in its unfolded tray-supporting position.

8. A tray as set forth in claim 7 wherein said latch member has a second notch therein for receiving a respective side portion of a respective leg releasably to latch the leg in its folded position.

9. A tray as set forth in claim 8 wherein said latch member has stop means thereon engageable by one side portion of a respective leg for preventing the leg from swinging past its tray-supporting position.

10. A tray as set forth in claim 9 wherein the other pivot member of each pair has stop means thereon engageable by the other side portion of a respective leg for preventing the leg from swinging past its tray-supporting position.

11. A tray as set forth in claim 7 wherein each actuator is movable by hand for springing the side portions of that leg with respect to one another to move said side portions out of said first notch of a respective latch member for enabling the leg to swing between its folded and unfolded positions.

12. A tray as set forth in claim 11 wherein each actuator is adapted for springing the side portions of a respective leg away from one another.

13. A tray as set forth in claim 11 wherein said one pivot member of each pair of pivot members comprises a first flange extending down from the tray in a plane generally perpendicular to the pivot axis of a respective leg, said latch member comprising an integral extension of said flange at the lower end thereof.

14. A tray as set forth in claim 13 wherein said latch member comprises a first generally horizontal flange portion bent from the lower end of said flange, and a second flange portion inclined upwardly from the horizontal portion away from said flange, said horizontal flange portion having said first notch therein and said inclined flange portion having a second notch therein for receiving a respective side portion of a respective leg thereby releasably to latch the leg in its folded position.

15. A tray as set forth in claim 14 wherein said one pivot member of each pair of pivot members has a second flange extending down from the underside of the tray generally parallel to said first flange, said end portion of a respective leg side portion extending through said first and second flanges for connection to a respective actuator.

16. A tray as set forth in claim 15 wherein said actuators are in the form of buttons operatively connected to said legs and slidable in slots in the tray for springing the side portions of each leg with respect to one another.

17. A tray as set forth in claim 16 wherein said actuator buttons are disposed within recesses in the tray so that the buttons do not project above the top of the tray.

18. A tray as set forth in claim 17 wherein said tray is of one piece molded construction, and said legs are in the form of generally U-shaped metal rods.

* * * * *